United States Patent [19]

Guth et al.

[11] 4,365,967

[45] Dec. 28, 1982

[54] METHOD OF TREATING, ESPECIALLY DYEING, WHITENING OR FINISHING, TEXTILE FABRICS

[75] Inventors: Christian Guth, Basel; Jörg Binz, Reinach, both of Switzerland

[73] Assignee: Ciba-Geigy Corporation, Ardsley, N.Y.

[21] Appl. No.: 214,306

[22] Filed: Dec. 8, 1980

[30] Foreign Application Priority Data

Dec. 14, 1979 [CH] Switzerland ..... 11095/79
May 21, 1980 [CH] Switzerland ..... 3961/80

[51] Int. Cl.[3] ..... D06P 1/613; D06M 13/26; D06M 13/18; D06M 15/30

[52] U.S. Cl. ..... 8/477; 427/393.1; 427/393.4; 427/387; 252/8.6; 252/8.9; 252/301.21; 252/301.35; 252/174.15; 252/307

[58] Field of Search ..... 8/477; 427/393.1, 393.4, 427/394; 252/8.6, 8.9, 301.21, 301.35

[56] References Cited

U.S. PATENT DOCUMENTS

| | | | |
|---|---|---|---|
| 3,084,661 | 4/1963 | Roberts | 118/50 |
| 3,183,254 | 5/1965 | Rossmy et al. | 260/448.2 |
| 3,507,815 | 4/1970 | Bailey et al. | 260/2.5 |
| 3,629,368 | 12/1971 | Fukuda et al. | 260/878 B |
| 3,697,314 | 10/1972 | Stritzko | 117/120 |
| 3,762,860 | 10/1973 | Abrahams et al. | 8/21 A |
| 3,913,359 | 10/1975 | Childers et al. | 68/183 |
| 3,990,840 | 11/1976 | von der Eltz et al. | 8/18 R |
| 4,023,526 | 5/1977 | Ashmus et al. | 8/477 |
| 4,099,913 | 7/1978 | Walter et al. | 8/173 |
| 4,118,526 | 10/1978 | Gregorian et al. | 427/350 |
| 4,193,762 | 3/1980 | Namboodri | 8/14 |

*Primary Examiner*—Maria Parrish Tungol
*Attorney, Agent, or Firm*—Edward McC. Roberts

[57] ABSTRACT

A method of treating, especially dyeing, whitening and/or finishing, textile fabrics, in particular carpets, with an aqueous foamed composition which, in addition to containing dye or fluorescent whitening agent and/or finishing agent, contains a foam stabilizer, a foam regulator, and, optionally, other assistants. The aqueous composition employed contains (a) 1 to 4 g/liter of an anionic or non-ionic surfactant, or a mixture thereof, as foam stabilizer, and
(b) 0.1 to 1 g/liter of an oxyalkylene-siloxane copolymer as foam regulator, said foam having a blow ratio of (6 to 20).1, applying said foam continuously, in the form of at least one layer, to the textile fabric, if desired vacuuming said fabric to effect penetration of the layer of foam through the fabric, and subsequently subjecting the fabric to a steam treatment.

Level dyeings with good penetration and/or excellent finishes are obtained on the treated textile fabrics.

30 Claims, No Drawings

METHOD OF TREATING, ESPECIALLY DYEING, WHITENING OR FINISHING, TEXTILE FABRICS

The present invention relates to the treatment, especially dyeing and/or finishing, of textile fabrics of pronounced three-dimensional character (pile fabrics), especially carpets, with foamed aqueous compositions.

Accordingly, the invention provides a method of treating, especially dyeing, whitening and/or finishing, textile fabrics, in particular carpets, with an aqueous foam composition which, in addition to containing a dye, fluorescent whitening agent or finishing agent, contains a foam stabiliser, a foam regulator, and, optionally, other assistants, which method comprises preparing a foam from the aqueous composition which contains (a) 1 to 4 g/liter of an ionic or non-ionic surfactant, or a mixture thereof, as foam stabiliser, and (b) 0.1 to 1 g/liter of an oxyalkylene-siloxane copolymer as foam regulator, said foam having a blow ratio of (6 to 20) to 1, applying said foam continuously, in the form of at least one layer, to the textile fabrics, if desired vacuuming said fabrics to effect preferably partial penetration of the layer of foam through the fabrics, and subsequently subjecting the fabrics to a steam treatment.

The substrates to be treated by the method of the invention can be produced from all conventional natural and/or man-made fabrics, e.g. from cotton, regenerated cellulose, polyester, polyacrylonitrile, polyamide 6 or polyamide 66, wool or blends thereof. Preferred substrates are pile fabrics and, especially, carpets (e.g. loop pile or cut-pile carpets having a weight of up to 2500 g/m$^2$) made from polyacrylonitrile, wool or, in particular, polyamide.

Suitable dyes for dyeing the above substrates are all common classes of dye, e.g. disperse dyes, vat dyes, reactive dyes, substantive dyes, acid, basic or metal complex dyes, as well as mixtures of such dyes customarily employed in practice. Examples of such dyes are described in the Colour Index, 3rd Edition 1971, Vol. 4.

If textile substrates are to be whitened by the method of the invention, then suitable fluorescent whitening agents are, for example, those of the styryl or stilbene series.

Suitable finishing agents which can be applied in the method of the invention are all chemical finishing agents which are suitable for use in the carpet sector, e.g. antistatic, antisoiling or soil release agents which impart a stiffening finish.

Components (a) and (b) of the preparations to be used in the practice of this invention are the actual foaming agents (foam stabilisers, foam regulators). The weight ratio of components (a) and (b) to each other is (2 to 40):1. Suitable foam stabilisers (a) are as a rule anionic or non-ionic compounds with surface active properties.

The anionic surfactants (a) are preferably alkylene oxide adducts, e.g. adducts containing acid ether groups, or preferably acid ester groups, of inorganic or organic acids, of alkylene oxides, especially ethylene oxide and/or propylene oxide or also styrene oxide, with organic hydroxyl, carboxyl, amino or amido compounds containing aliphatic hydrocarbon radicals having a total of at least 2 carbon atoms, or mixtures thereof. These acid ethers or esters can be in the form of the free acids or salts, e.g. alkali metal salts, alkaline earth metal salts, ammonium or amine salts.

These anionic surfactants are obtained by known methods, by addition of at least 1 mole, preferably of more than 1 mole, e.g. 2 to 60 moles, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are e.g. higher fatty alcohols, i.e. alkanols or alkenols, each containing 8 to 22 carbon atoms, dihydric to hexahydric aliphatic alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having at least 8 carbon atoms, especially fatty amines containing such radicals, hydroxyalkylamines, hydroxyalkylamides and aminoalkyl esters of fatty acids or dicarboxylic acids and higher alkylated aryloxycarboxylic acids.

Examples of suitable anionic surfactants are:

sulfated aliphatic alcohols which contain 8 to 18 carbon atoms in the alkyl chain, e.g. sulfated lauryl alcohol, oleyl alcohol or coconut fatty alcohol;

sulfated unsaturated fatty acids or fatty acid lower alkyl esters which contain 8 to 20 carbon atoms in the fatty radical, e.g. oleic acid or ricinic acid and oils containing such fatty acids, e.g. castor oil;

alkylsulfonates containing 8 to 20 carbon atoms in the alkyl chain, e.g. dodecylsulfonate;

alkylarylsulfonates with linear or branched alkyl chain containing at least 6 carbon atoms, e.g. dodecylbenzenesulfonates or 3,7-diisobutylnaphthalenesulfonates;

sulfonates of polycarboxylic acid esters, e.g. dioctylsulfosuccinates;

the alkali metal, ammonium or amine salts of fatty acids containing 10 to 20 carbon atoms, e.g. rosin salts, classified as soaps;

esters of polyalcohols, especially mono- or diglycerides of fatty acids containing 12 to 18 carbon atoms, e.g. monoglycerides of lauric, stearic or oleic acid; and the adducts of 1 to 60 moles of ethylene oxide and/or propylene oxide with fatty amines, fatty acids or fatty alcohols, each containing 8 to 22 carbon atoms, with alkylphenols containing 4 to 16 carbon atoms in the alkyl chain, or with trihydric to hexahydric alkanols containing 3 to 6 carbon atoms, which adducts are converted into an acid ester with an organic dicarboxylic acid, e.g. maleic acid, malonic acid or sulfosuccinic acid, but preferably with an inorganic polybasic acid such as o-phosphoric acid or, in particular, sulfuric acid.

Very suitable anionic surfactants for use as component (a) (foam stabiliser) are (1) acid esters, or salts thereof, of a polyadduct of 2 to 15 moles of ethylene oxide with 1 mole of a fatty alcohol containing 8 to 22 carbon atoms, or with 1 mole of an alkylphenol containing 4 to 12 carbon atoms in the alkyl moiety, (2) alkylphenylsulfonates containing 8 to 18 carbon atoms in the alkyl moiety, (3) sulfonated 1-benzyl-2-alkylbenzimidazoles containing 8 to 22 carbon atoms in the alkyl moiety, which components (1), (2) and (3) can be used individually or in admixture.

Component (1) of the above preferred foam stabilisers can have e.g. the formula

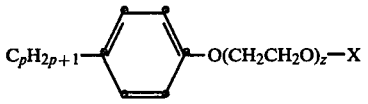

(1)

or $$R—O—(CH_2CH_2—O)_z—X \quad (2)$$

wherein R is alkyl or alkenyl, each of 8 to 22 carbon atoms, X is the acid radical of an inorganic oxygen-containing acid, or the radical of an organic acid, p is 4 to 12, and z is 2 to 12.

The alkyl radicals at the benzene ring of the formula (1) can be butyl, hexyl, n-octyl, n-nonyl, p-tert-octyl, p-tert-nonyl, decyl or dodecyl. Preferred alkyl radicals are those containing 8 to 12 carbon atoms, with octyl and nonyl radicals being most preferred.

The acid radical X is derived, for example, from a low molecular dicarboxylic acid, e.g. from maleic acid, malonic acid, succinic acid or sulfosuccinic acid, and is bonded to the oxyethylene part of the molecule through an ester bridge. In particular, X is derived from an inorganic polybasic acid such as orthophosphoric acid and, in particular, sulfuric acid. The acid radical X exists preferably in salt form, i.e. for example in the form of an alkali metal salt, or ammonium or amine salt. Examples of such salts are: lithium, sodium, potassium, ammonium, trimethylamine, ethanolamine, diethanolamine or triethanolamine salts.

The fatty alcohols for obtaining component (1) of formula (2) are e.g. those containing 8 to 22, preferably 8 to 18, carbon atoms, such as octyl, decyl, lauryl, tridecyl, myristyl, cetyl, stearyl, oleyl, arachidyl or behenyl alcohol.

The ester formation is effected as a rule with the same acids as mentioned for the compounds of formula (1). A preferred foam stabiliser of the formula (2) is the sodium salt of lauryltriglycol ether sulfonic acid.

The following compounds may be cited in particular as examples of components (1) of formulae (1) and (2):

1. the ammonium salt of the acid sulfuric acid ester of the polyadduct of 2 moles of ethylene oxide and 1 mole of p-tert-nonylphenol;
2. the sodium salt of the acid maleic acid ester of the polyadduct of 2 moles of ethylene oxide and 1 mole of p-nonylphenol;
3. the ammonium salt of the acid sulfuric acid ester of the polyadduct of 3 moles of ethylene oxide and 1 mole of p-butylphenol;
4. the ammonium salt of the acid phosphoric acid ester of the polyadduct of 2 moles of ethylene oxide and 1 mole of p-nonylphenol;
5. the sodium salt of the disulfosuccinic acid ester of the polyadduct of 4 moles of ethylene oxide and 1 mole of n-octylphenol;
6. the ammonium salt of the acid sulfuric acid ester of the polyadduct of 9 moles of ethylene oxide and 1 mole of p-nonylphenol;
7. the ammonium salt of the acid sulfuric acid ester of the polyadduct of 6 moles of ethylene oxide and 1 mole of p-nonylphenol;
8. the sodium salt of the monosulfosuccinic acid ester of the polyadduct of 2 moles of ethylene oxide and 1 mole of p-nonylphenol;
9. the ammonium salt of the acid sulfuric acid ester of the polyadduct of 6 moles of ethylene oxide and 1 mole of dodecylphenol;
10. the ammonium salt of the acid sulfuric acid ester of the polyadduct of 2 moles of ethylene oxide and 1 mole of octylphenol;
11. the ammonium salt of the acid sulfuric acid ester of the polyadduct of 2 moles of ethylene oxide and 1 mole of alfol (1014);
12. the ammonium salt of the acid sulfuric acid ester of the polyadduct of 2 moles of ethylene oxide and 1 mole of stearyl alcohol;
13. the ammonium salt of the acid sulfuric acid ester of the polyadduct of 3 moles of ethylene oxide and 1 mole of 2-ethyl-hexanol;
14. the ammonium salt of the acid sulfuric acid ester of the polyadduct of 15 moles of ethylene oxide and 1 mole of stearyl alcohol;
15. the ammonium salt of the acid sulfuric acid ester of the polyadduct of 3 moles of ethylene oxide and 1 mole of tridecyl alcohol;
16. the ammonium salt of the acid sulfuric acid ester of the polyadduct of 4 moles ethylene oxide and 1 mole of hydroabietyl alcohol;
17. the ammonium salt of the acid sulfuric acid ester of the polyadduct of 3 moles of ethylene oxide and 1 mole of alfol (2022);
18. the ammonium salt of the acid sulfuric acid ester of the polyadduct of 3 moles of ethylene oxide and 1 mole or lauryl alcohol;
19. the di-($\beta$-hydroxyethyl)amine salt of the acid sulfuric acid ester of the polyadduct of 3 moles of ethylene oxide and 1 mole of lauryl alcohol;
20. the sodium salt of the acid sulfuric acid ester of the polyadduct of 2 moles of ethylene oxide and 1 mole of lauryl alcohol;
21. the sodium salt of the acid sulfuric acid ester of the polyadduct of 3 moles of ethylene oxide and 1 mole of lauryl alcohol;
22. the acid phosphoric acid ester of the polyadduct of 5 moles of ethylene oxide and 1 mole of 2-ethylhexanol;
23. the ammonium salt of the acid sulfuric acid ester of the polyadduct of 3 moles of ethylene oxide and 1 mole of a mixture of alcohols containing 20 to 22 carbon atoms;
24. the diphosphoric acid ester of the polyadduct of 8 moles of ethylene oxide and 1 mole of dodecylamine;
25. the ammonium salt of the acid phosphoric acid ester of the polyadduct of 8 moles of ethylene oxide and 1 mole of tallow fatty amine.

The alkylphenylsulfonates of component (2) are as a rule alkali metal salts of the corresponding monosulfonic acids containing 8 to 18 carbon atoms in the alkyl moiety, which is straight-chain or branched, saturated or unsaturated. Examples of suitable alkyl radicals are: n-octyl, tert-octyl, n-nonyl, tert-nonyl, n-decyl, n-dodecyl, tridecyl, myristyl, cetyl, stearyl or oleyl. Preferred alkyl radicals are those containing 8 to 12 carbon atoms, and the sodium salt of dodecylbenzenesulfonate is particularly suitable.

Component (3) is a sulfonated 1-benzyl-2-alkylbenzimidazole containing 8 to 12 carbon atoms in the alkyl moiety. The alkyl radicals are derived from the acids referred to above.

Preferred sulfonated benzimidazole derivatives which can be obtained by condensation of o-phenylenediamine with saturated or unsaturated fatty acids containing 12 to 18, preferably 16 to 18, carbon atoms (palmitic, stearic, oleic acid), are those containing 2 sulfonic acid groups. The disodium salt of 1-benzyl-2-heptadecylbenzimidazole-disulfonic acid may be mentioned as preferred compound.

Components (1) to (3) can used individually or also in admixture with one another as foam stabilisers.

The non-ionic surfactant of component (a) is advantageously a non-ionic adduct of 1 to 100 moles of alkylene oxide, e.g. ethylene oxide or propylene oxide, and 1 mole of an aliphatic monoalcohol containing at least 4 carbon atoms, of a trihydric to hexahydric aliphatic alcohol, of an unsubstituted or alkyl- or phenyl-substituted phenol, or of a fatty acid containing 8 to 22 carbon atoms.

The aliphatic monoalcohols employed for obtaining the non-ionic surfactants are e.g. water-insoluble monoalcohols containing at least 4, preferably 8 to 22, carbon atoms. These alcohols can be saturated or unsaturated and branched or straight-chain, and they can be employed individually or in admixture. It is possible to react natural alcohols, e.g. myristyl alcohol, cetyl alcohol, stearyl alcohol or oleyl alcohol, or synthetic alcohols such as, in particular, 2-ethylhexanol, and also trimethylhexanol, trimethylnonyl alcohol, hexadecyl alcohol or the above mentioned alfols, with the alkylene oxide.

Further aliphatic alcohols which can be reacted with alkylene oxide are trihydric to hexahydric alkanols. These contain advantageously 3 to 6 carbon atoms and are, in particular, glycerol, trimethylolpropane, erythritol, mannitol, pentaerythritol and sorbitol. The trihydric to hexahydric alcohols are preferably reacted with propylene oxide or ethylene oxide or with mixtures thereof.

Examples of suitable unsubstituted or substituted phenols are phenol, o-phenylphenol or alkylphenols containing 1 to 16, preferably 4 to 12, carbon atoms, in the alkyl moiety. Examples of these alkylphenols are: p-cresol, butylphenol, tributylphenol, octylphenol and, in particular, nonylphenol.

The fatty acids contain preferably 8 to 12 carbon atoms and can be saturated un unsaturated, e.g. capric, lauric, myristic, palmitic or stearic acid, and decenoic, dodecenoic, tetradecenoic, hexadecenoic, oleic, linoleic, linolenic or, preferably, ricinolic acid.

Representative examples of non-ionic surfactants are:

polyadducts of preferably 5 to 80 moles of alkylene oxides, especially ethylene oxide, individual ethylene oxide units of which can be replaced by substituted epoxides such as styrene oxide and/or propylene oxide, with higher unsaturated or saturated fatty alcohols, fatty acids, fatty amines or fatty amides containing 8 to 22 carbon atoms, or with phenylphenol or alkylphenols, the alkyl moieties of which contain at least 4 carbon atoms;

alkylene oxide condensation products, especially ethylene oxide and/or propylene oxide condensation products;

reaction products of a fatty acid containing 8 to 22 carbon atoms and a primary or secondary amine which contains at least one hydroxy-lower alkyl or lower alkoxy-lower alkyl group, or alkylene oxide adducts of these hydroxyalkylated reaction products, the reaction being so conducted that the molecular ratio of hydroxyalkylamine to fatty acid can be 1:1 and greater than 1, e.g. 1.1:1 to 2:1; and polyadducts of propylene oxide with a trihydric to hexahydric aliphatic alcohol containing 3 to 6 carbon atoms, e.g. glycerol or pentaerythritol, said polypropylene oxide adducts having an average molecular weight of 250 to 1800, preferably 400 to 900.

Very suitable non-ionic surfactants for use as foam stabiliser (a) are:

(4) polyadducts of 2 to 15 moles of ethylene oxide and 1 mole of a fatty alcohol or fatty acid, each containing 8 to 22 carbon atoms, or 1 mole of an alkylphenol containing a total of 4 to 12 carbon atoms in the alkyl moiety;

(5) fatty alcohols which can be mono-, di- or triethoxylated and which contain 8 to 22 carbon atoms in the fatty alcohol radical, or (6) fatty acid dialkanolamides containing 8 to 22 carbon atoms in the fatty acid radical.

Suitable compounds for use as component (4) of the foam stabilisers are advantageously polyadducts of octylphenol or, preferably, nonylphenol, and ethylene oxide, said polyadducts containing 2 to 12 ethylene oxide units and which can have in particular the formula

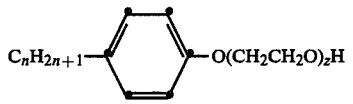

(3)

wherein n is 8 or 9 and z is 2 to 12. The alkyl substituents at the phenol ring can be straight-chain or branched.

Specific examples of polyadducts derived from octylphenol and nonylphenol are: p-nonylphenol/9 moles of ethylene oxide, p-octylphenol/2 moles of ethylene oxide, p-nonylphenol/10 moles of ethylene oxide, p-nonylphenol/11 moles of ethylene oxide.

Further polyadducts of alkylphenol and ethylene oxide can be derived e.g. from butylphenol or tributylphenol.

Component (4) can also desirably be a polyadduct of 2 to 15 moles, preferably 7 to 15 moles, of ethylene oxide and 1 mole of an aliphatic monoalcohol containing 8 to 22 carbon atoms.

The aliphatic monoalcohols can be saturated or unsaturated and used individually or in admixture with each other. It is possible to react natural alcohols, e.g. lauryl alcohol, myristyl alcohol, cetyl alcohol, stearyl alcohol, oleyl alcohol, or synthetic alcohols such as, in particular, 2-ethylhexanol, and also trimethylhexanol, trimethylnonyl alcohol, hexadecyl alcohol or the $C_{12}$–$C_{22}$alfols, with ethylene oxide.

Polyadducts of 2 to 15 moles of ethylene oxide and 1 mole of fatty acid can also be used as component (4). The fatty acids preferably contain 10 to 20 carbon atoms and can be saturated or unsaturated. Examples are: capric, lauric, myristic, palmitic or stearic acid, and decenoic, dodecenoic, tetradecenoic, hexadecenoic, oleic, linolic or ricinolic acid.

Component (5) is an optionally ethoxylated fatty alcohol as defined herein having an HLB value of preferably 0.1 to 10, most preferably 0.5 to 10. Components (5) having HLB values in the range from 0.1 to 7 are especially advantageous (the HLB value stands for the hydrophilic/lipophilic balance in the molecule). The HLB values can be determined or calculated experimentally in accordance with the method of W. C. Griffith, ISCC 5, 249 (1954) or of J. T. Davis, Tenside Detergens 11, (1974), No. 3, p. 133.

The fatty alcohols suitable for use as component (5) can be saturated or unsaturated. They contain preferably 12 to 18 carbon atoms. Examples of such alcohols are: lauryl, myristyl, cetyl, stearyl, oleyl, arachidyl, or behenyl alcohol, or $C_{12}$–$C_{22}$alfols. These fatty alcohols can advantageously be mono-, di- or triethoxylated.

Preferred components (5) are cetyl alcohol or diethylene glycol cetyl ether (=polyoxyethylene-(2)-cetyl ether of the formula $C_{16}H_{33}$—O—$(CH_2CH_2O)_2$—H).

The fatty acid/alkanolamine reaction products of component (6) are e.g. products which are obtained from fatty acids containing 8 to 22, preferably 8 to 18, carbon atoms, and alkanolamines containing 2 to 6 carbon atoms, e.g. ethanolamine, diethanolamine, isopropanolamine or diisopropanolamine. Diethanolamine is preferred. Fatty acid diethanolamides containing 8 to 18 carbon atoms are especially preferred.

Examples of suitable fatty acids are: caprylic, capric, lauric, myristic, palmitic, stearic, arachidic, behenic, oleic, linolic, linolenic, arachidonic or coconut fatty acid.

Preferred examples of such reaction products are coconut fatty acid diethanolamide and also lauric or stearic acid diethanolamide.

Further very suitable non-ionic surfactants are alkylene oxide polyadducts of the formula $$R'-O-(CH_2CH_2-O)_{n_1}-(\underset{Z_1}{CH}-\underset{Z_2}{CH}-O)_y-(CH_2CH_2O)_{n_2}-H \quad (4)$$

wherein R′ is hydrogen, alkyl or alkenyl, each containing at most 18, preferably 8 to 16, carbon atoms, o-phenylphenyl or alkylphenyl containing 4 to 12 carbon atoms in the alkyl moiety, one of $Z_1$ and $Z_2$ is hydrogen and the other is methyl, y is 1 to 15, and the sum of $n_1+n_2$ is 3 to 15.

Particularly advantageous non-ionic surfactants are fatty alcohol polyglycol mixed ethers, especially polyadducts of 3 to 10 moles of ethylene oxide and 3 to 10 moles of propylene oxide with aliphatic monoalcohols containing 8 to 16 carbon atoms.

The following polyadducts are examples of alkylene oxide polyadducts of formula (4):

1. the polyadduct of 12 moles of ethylene oxide and 12 moles of propylene oxide with 1 mole of a $C_4$–$C_{18}$ fatty alcohol,
2. the polyadduct of 5 moles of ethylene oxide and 5 moles of propylene oxide with 1 mole of alfol (12–14),
3. the polyadduct of 9 moles of ethylene oxide and 7 moles of propylene oxide with 1 mole of a $C_{16}$–$C_{18}$ fatty alcohol,
4. the polyadduct of 9.5 moles of ethylene oxide and 9.5 moles of propylene oxide with 1 mole of nonylphenol.

Preferred foam stabilisers (a) are combinations of components (1), (2), (4), (5) and (6) and, optionally, also of component (3). Components (1), (2), (4), (5) and (6) can also with advantage be used individually as foam stabilisers.

Preferred single components are the polyadduct of 1 mole of nonylphenol and 2 moles of ethylene oxide, the ammonium salt of the acid sulfuric acid ester of the polyadduct of 1 mole of nonylphenol and 2 moles of ethylene oxide, sodium lauryl triglycol ether sulfate, sodium dodecylphenylsulfonate, or a fatty acid diethanolamide containing 8 to 18 carbon atoms in the fatty acid radical (coconut fatty acid diethanolamide).

Examples of preferred mixtures of foam stabilisers are those of (1) nonylphenol/ethylene oxide polyadducts containing 10 to 12 ethylene oxide units, sodium salts of sulfuric acid esters of fatty alcohol/ethylene oxide polyadducts containing 10 to 12 carbon atoms in the alcohol radical and 2 to 4 ethylene oxide units and coconut fatty acid diethanolamide, (2) polyadducts of 7 to 15 moles of ethylene oxide and 1 mole of stearyl alcohol, coconut fatty acid diethanolamide and cetyl alcohol or diethoxylated cetyl alcohol, (3) dodecylbenzenesulfonate, sodium lauryl triglycol ether sulfate, coconut fatty acid diethanolamide and the disodium salt of 1-benzyl-2-stearylbenzimidazole-disulfonic acid, or (4) sodium lauryl triglycol ether sulfate and fatty acid diethanolamides containing 8 to 18 carbon atoms in the fatty acid radical.

The foam components or foam stabilisers (a) are very good foaming agents, i.e. they are able on the one hand to form sufficient foam when used in small amount, and, on the other hand, also to stabilise the foam so formed.

The oxyalkylene-siloxane copolymers employed as foam regulators (b) are, for example, reaction products of halogen-substituted organopolysiloxanes and alkali metal salts of polyoxyalkylene, e.g. polyethylene glycols or polypropylene glycols.

Such compounds, which have a poly-dimethylsiloxane skeleton, can have the formula $$(CH_3)_3Si-O-\left[\begin{array}{c}CH_3\\|\\Si-O\\|\\CH_3\end{array}\right]_q-\left[\begin{array}{c}CH_3\\|\\Si-O\\|\\(CH_2)_r\\|\\O-(C_3H_6O)_s(CH_2CH_2O)_t-R_1\end{array}\right]_x-Si(CH_3)_3 \quad (5)$$

wherein q is 3 to 50, preferably 3 to 25, r is 2 or 3, s is 0 to 15, t is 1 to 25, x is 3 to 15, preferably 3 to 10, and $R_1$ is alkyl of 1 to 6 carbon atoms, preferably methyl. Such compounds are described e.g. in German Auslegeschrift No. 1 719 328.

Representatives of the oxyalkylene-siloxane copolymers of the formula (5) can be illustrated by the following formulae:

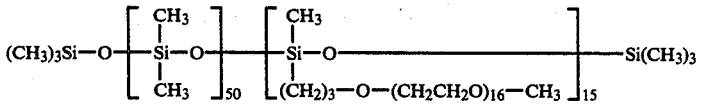
(6)
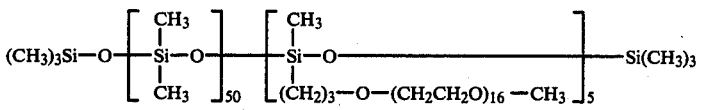
(7)
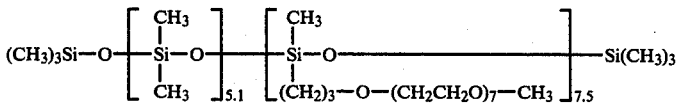
(8)
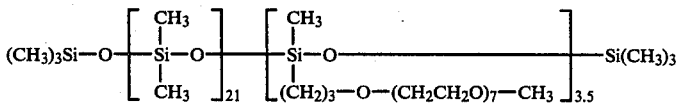
(9)
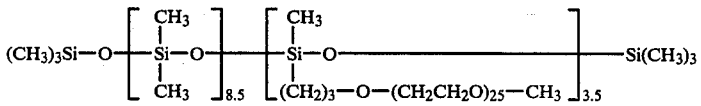
(10)
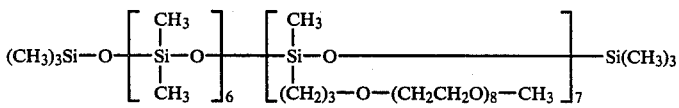
(11)
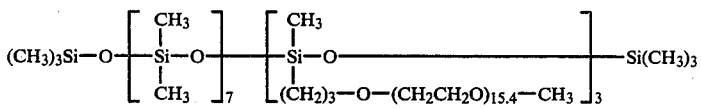
(12)
Further polyether siloxanes which can be employed as foam regulators (b) are of the formula
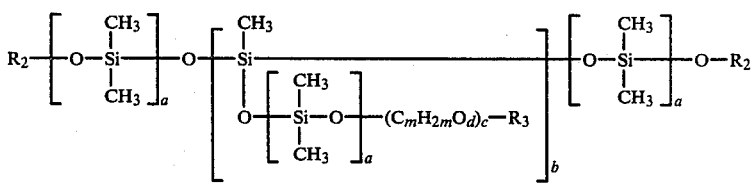
(13)
wherein each of $R_2$ and $R_3$ is alkyl of 1 to 4 carbon atoms, preferably methyl, a is 1 to 20, b is 2 to 20, c is 2 to 50, d is 1 or 2, and m is 2 to 5. Such siloxane compounds are described in German Auslegeschrift No. 1 795 557.
Typical representatives of these siloxane-polyalkylene oxide copolymers are:
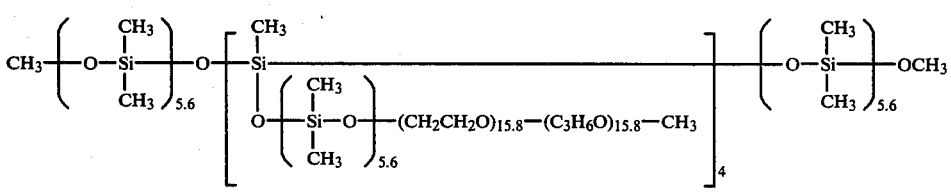
(14)
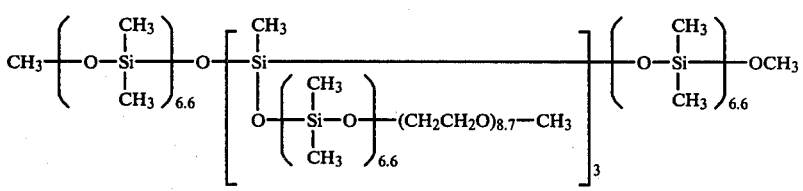
(15)

Preferred polyether siloxanes employed as foam regulators (b) have a cloud point of about 20° to 70° C., preferably 25° to 50° C. The glycol content consisting essentially of polyoxyethylene groups or polyoxyethylene/polyoxypropylene groupings is advantageously from 35 to 80% by weight, preferably from 40 to 70% by weight, based on the weight of the polyether siloxane.

Component (b) does not hinder the foam formation, but has the property of collapsing the foam under the influence of moisture and heat, i.e. causing it to deliquesce. This action results from the property of this component of having an especially pronounced cloud point in aqueous solution at 40°–50° C., i.e. it has an antifoam action at elevated temperature.

Depending on the desired effect, the foams to be employed in the practice of this invention contain additional ingredients such as acids, alkalies, catalysts, urea, oxidants, solvents or emulsifiers. The acids and alkalies are used in particular for adjusting the pH value of the liquor employed, which, depending on the substrate to be treated, is usually from 4 to 10, preferably 4 to 6.5.

It is not necessary to add a thickener, as the foams are sufficiently stable without a thickener, i.e. they can have half-lives of up to 60 minutes. Their penetration properties are good. A good wetting and easy penetration of the foam is ensured.

The procedure for preparing the foams is preferably such that the foaming components (a) and (b) are first dissolved separately and then mixed with each other to give aqueous solutions containing 0.1 to 0.5% by weight of foaming components. The foams are produced preferably mechanically using impellers, mixers or also special foam pumps, with which latter is also possible to produce the foams continuously. It is desirable to dissolve or disperse the individual components before they are added to the foaming apparatus. In the practice of this invention, blow ratios, i.e. volume ratios of foamed to unfoamed preparation, of 6:1 to 20:1, preferably 8:1 to 12:1, have proved suitable.

The foams employed in this invention have the property of being stable over a prolonged period of time and of not deliquescing immediately when applied to the substrate. The foams preferably have half-lives of 5 to 30 minutes. The bubbles in the foams have diameters from about 1 to 100$\mu$. Application of the foams is usually made at room temperature, i.e. at about 15°–30° C.

For dyeing or finishing carpets and pile fabrics made of polyamide, wool, polyacrylonitrile or polyester, a treatment liquor is foamed and the foam is applied in the foam of a layer to the pile from a foam container (with knife for adjusting the desired thickness of the foam layer) via a roller with a take-up blade. The substrates do not necessarily need to be pretreated, but they can also be prewetted at room temperature (with aqueous liquors containing conventional wetting agents, e.g. 1 g/l of a polyadduct of alkylphenol and ethylene oxide), or prewashed in the temperature range up to 80° C. (with conventional detergents) and texturised. If these pretreatments are carried out, then it is appropriate to remove water from the substrate, before application of the foam, to a residual moisture content of 40 to 100% by weight, based on the weight of the substrate. The layer of foam is partially drawn through the substrate (the carpet pile), without any loss of treatment liquor, by applying a vacuum (about 0.1 to 1 bar) to the back of the substrate. In the course of this step, the height of the foam can be reduced by about 10 to 70% of the original height, and the foam is thereby uniformly distributed from the tip almost to the roots of the pile. If desired, a second layer of foam can then be applied with the knife. The entire add-on of treatment liquor, based on the weight of the dry carpet, is advantageously from 70 to 250%, preferably from 70 to 200%, and, most preferably, from 120 to 170%. By means of this method it is also possible to dye differently dyeable polyamide carpet pile fabric and to obtain a good differential dyeing effect.

The vacuum to be applied depends largely on the weight of the carpet per square meter, the construction of the support fabric, the thickness of the carpet, the length of the pile, and also on the blow ratio of the foam. In the range of >0 to 1 bar, it is possible to obtain a partial penetration of the layer of foam into the carpet by removing water. It is important that the layer of foam remaining on the pile side remains as uniformly thick as possible. Too deep penetration results in a loss of liquor and can lead to unlevel dyeings or to dyeings with frosting effect.

The carpet is then run into the steamer with a layer of foam still present on the pile side. On entering the steamer, the layer of foam begins to rise slightly and thus prevents frosting. The foam is then uniformly collapsed with the aid of the foam regulator (b)—by the action of the saturated steam, i.e. it deliquesces, and the dye liquor penetrates deeper into the pile fabric, so that a level dyeing free from frosting is obtained. The foam must be completely collapsed after less than 20 seconds in order to obtain a good surface levelness.

Before applying the foam, it can be advantageous to pad the substrate with a padding liquor which preferably contains foaming agents, especially components (a) and (b). In this case the impregnation is effected at a liquor pick-up of 40 to 100% by weight. The subsequent add-on of foam is normally 50 to 180% by weight, preferably 50 to 150% by weight. After this preloading treatment with an impregnating liquor which can already contain a foaming agent and the subsequent application of foam, the vacuuming to effect penetration of the foam into the substrate can be successfully dispensed with and the steam treatment carried out direct.

The fixation of the dyes and finishing agents is effected by subjecting the substrate to a steam treatment, e.g. in the temperature range from 95° to 180° C., preferably from 98° to 102° C., e.g. with saturated steam or superheated steam. After fixation, the substrate can be given a washing off (sprayed with water), rinsed and dried, e.g. in the temperature range from 100° to 130° C. If finishing agents are applied, then only drying and fixation are effected.

The method of this invention affords very substantial advantages compared with known methods. As in foam dyeing a small amount of moisture is applied compared with the conventional continuous process, in which the amount of dye liquor, based on the carpet fabric, is up to 500%, and only ⅓ of the application is made, higher production rates are possible. In addition, there is an improved bulk development, which results in an increase in quality. Further, vertical barriness in polyamide cut-pile grades is avoided.

As a result of the small amounts of liquid employed, the waste-water will also put no great strain on the plant-which is valuable from the ecological point of view. The saving in water and energy is also an advantageous consequence of the method of the invention, as is too the fact that there is no loss of dye liquor in the steamer.

The dyes and/or fluorescent whitening agents employed in the following Examples have the formulae:

(10)

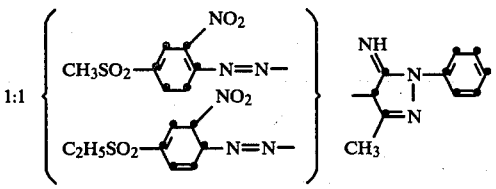

(11)

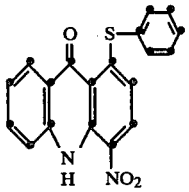

(12)

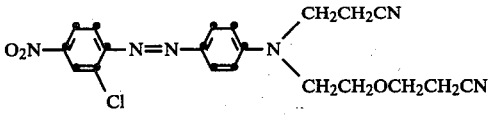

(13)

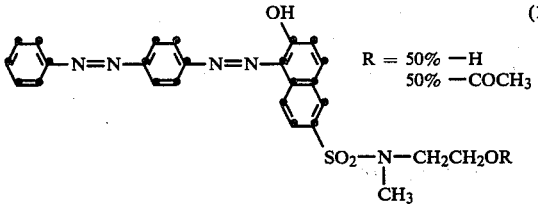

R = 50% —H
50% —COCH3

(14)

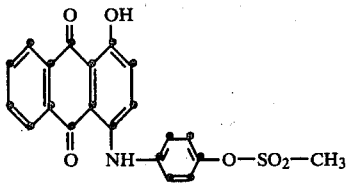

(15)

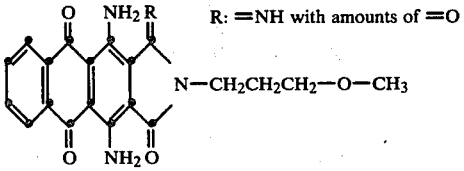

R: =NH with amounts of =O

= mixture of (16)

(16.1)

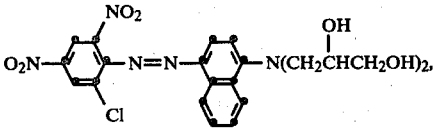

-continued (16.2)

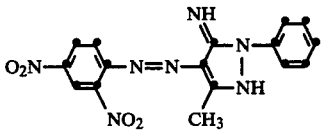

and the dye of the formula (10)

(17)

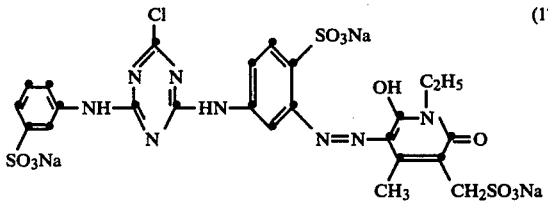

(18)

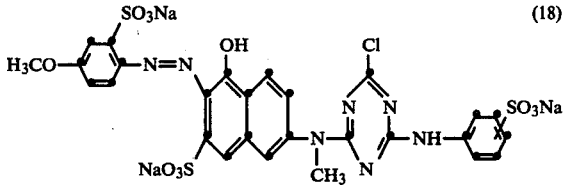

(19)

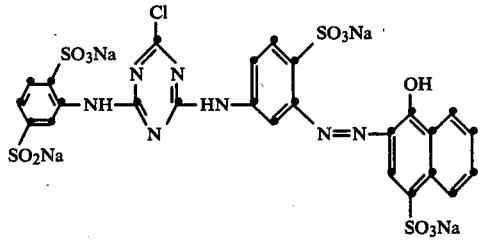

(20)

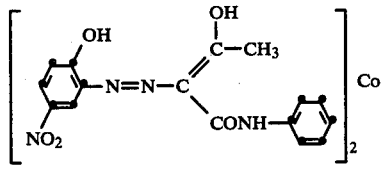

(21)

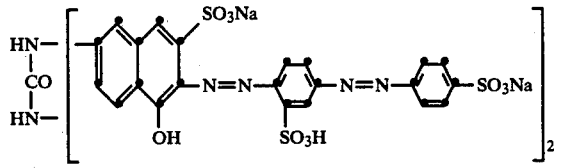

(22)

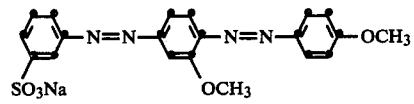

(23)

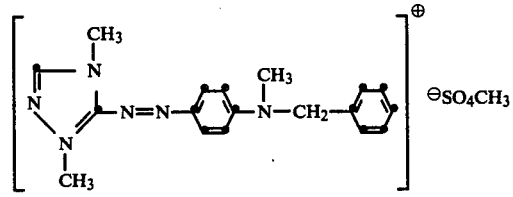

-continued

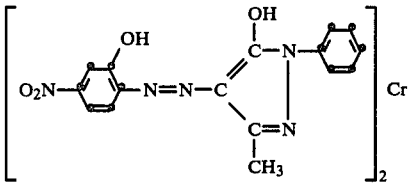

= mixture of

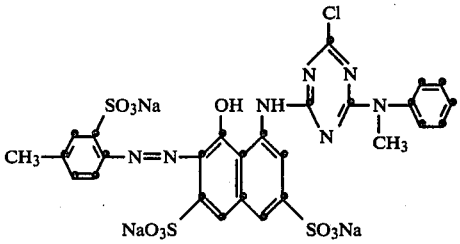

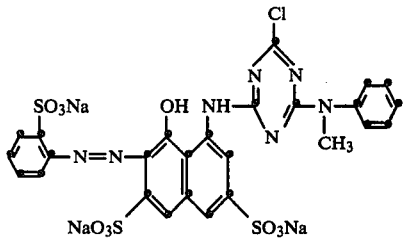

and

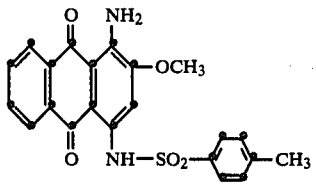

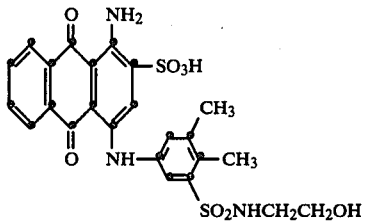

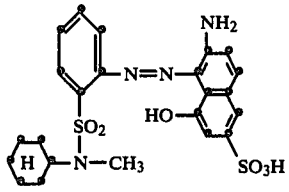

-continued (24)

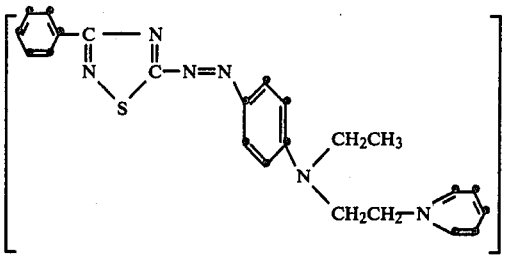

(25)

(25.1)

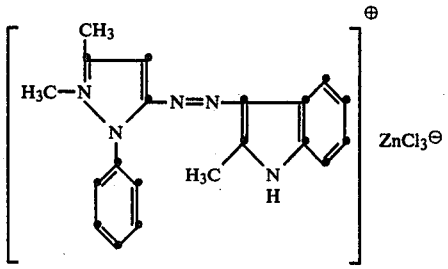

(25.2)

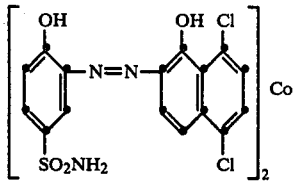

(25.3)

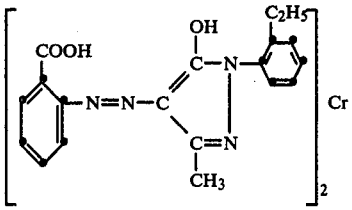

fluorescent whitening agents (26)

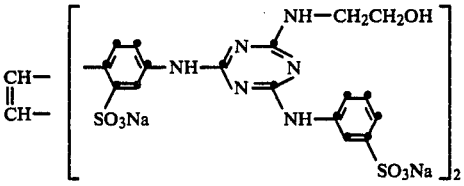

(27)

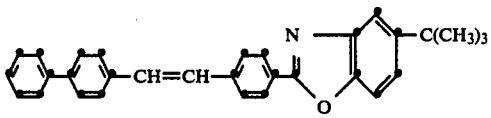

In the following Examples, parts and percentages are by weight.

EXAMPLE 1

500 $m^2$ of a polyamide 66 cut-pile carpet (brushed goods backed with polypropylene tape fabric) having a weight of 535 $g/m^2$ are continuously prewetted in a liquor which contains 1 g/liter of the polyadduct of 1 mole of nonylphenol and 9 moles of ethylene oxide, and then centrifuged to a pick-up of 40% by weight.

A dye foam having a blow ratio of 10:1 is prepared in a mixer from an aqueous liquor of the following composition:

0.6 g/l of the dye of the formula (22),
0.35 g/l of the dye of the formula (26),
0.40 g/l of the dye of the formula (27),
2.5 g/l of a foam stabiliser mixture consisting of coconut fatty acid diethanolamide/nonylphenol polyglycol(11) ether and sodium lauryl triglycol ether sulfate,
0.6 g/l of the oxyalkylene-siloxane copolymer of the formula (6),
1 g/l of sodium acetate, and acetic acid for adjusting the pH value of the liquor to 6.

This foam is then applied from a container, equipped with a knife for adjusting the desired thickness of the foam, by means of a roll to the pile side of the carpet which passes through the dyeing range at a rate of 9 m/minute. The height of the foam is 8 mm. The foam add-on is 135%.

A vacuum (~0.1 bar) is then applied to the back of the carpet in order to effect partial penetration of the layer of foam into the carpet, whereby the height of the foam is somewhat reduced. The carpet then passes over a conveyor roll into a steamer (102° C., saturated steam), where the foam rises slightly and is then collapsed. The carpet is subsequently sprayed with water of 80° C., then centrifuged, and dried at 100°–130° C. in a cylindrical sieve drier.

The carpet fabric is dyed in a level beige shade with excellent penetration of the dye. The foam dyeing has a positive influence on the softness and bulk of the fabric.

Further foam stabiliser mixtures which can also be successfully employed are those of dodecylbenzenesulfonate, coconut fatty acid ethanolamide, sodium lauryl triglycol ether sulfate and the sodium salt of 1-benzyl-2-stearylbenzimidazole-disulfonic acid (0.5/1/1/1); and also a mixture of lauric acid diethanolamide and sodium lauryl triglycol ether sulfate (1/1), as well as sodium dodecylbenzenesulfonate, coconut fatty acid diethanolamide, sodium lauryl triglycol ether sulfate, the polyadduct of 1 mole of nonylphenol and 9 moles of ethylene oxide, or the ammonium salt of the acid sulfuric acid ester of the polyadduct of 1 mole of nonylphenol and 2 moles of ethylene oxide.

The compounds of the formulae (7) to (15), or mixtures thereof, can also be used as foam regulators.

EXAMPLE 2

A polyamide 6 carpet having a weight of 2000 g/m$^2$ is impregnated on a pad to a pick-up of 70% with a liquor of the following composition:

0.6 g/l of the dye of the formula (22),
0.4 g/l of the dye of the formula (26),
0.4 g/l of the dye of the formula (27),
5 g/l of a mixture of the di-(β-hydroxyethyl)amine salt of the acid sulfuric acid ester of the polyadduct of 3 moles of ethylene oxide and 1 mole of lauryl alcohol, and coconut fatty acid N,N-bis(β-hydroxyethyl)amide (1:1), and sodium hydroxide solution (30° Be) for adjusting the pH value of the liquor to 8.

A liquor of the following composition is then foamed and applied in the same manner as described in Example 1:

0.6 g/l of the dye of the formula (22),
0.4 g/l of the dye of the formula (26),
0.4 g/l of the dye of the formula (27),
2 g/l of a mixture consisting of 53% of coconut acid fatty acid diethanolamide, 0.3% of the polyadduct of 15 moles of ethylene oxide and 1 mole of stearyl alcohol, 3.3% of cetyl alcohol and 43.4% of water,
4 g/l of the oxyalkylene-siloxane copolymer of the formula (6), and sodium hydroxide solution (30° Be) for adjusting the pH value of the liquor to 8. The blow ratio is 8:1.

This foam is applied to the pile side of the previously impregnated carpet. The add-on is 70%, based on the weight of the dry carpet. The carpet is then treated with saturated steam for 4 minutes in a horizontal steamer at 98° C. and subsequently rinsed and dried. A beige dyeing of excellent light- and wetfastness is obtained.

EXAMPLE 3

A polyamide 66 cut-pile carpet having a weight of 610 g/m$^2$ is prewetted continuously in a liquor which contains 1 g/liter of the polyadduct of 9 moles of ethylene oxide and 1 mole of nonylphenol, and then centrifuged to a pick-up of 50% by weight. A dye foam having a blow ratio of 9:1 is prepared in a foaming apparatus from an aqueous liquor of the following composition:

0.7 g/l of the dye of the formula (22),
0.52 g/l of the dye of the formula (26),
0.15 g/l of the dye of the formula (27),
2 g/l of the ammonium salt of the acid sulfuric acid ester of the polyadduct of 2 moles of ethylene oxide and 1 mole of nonylphenol,
4 g/l of the oxyalkylene-siloxane copolymer of the formula (6),
2 g/l of a N-quaternised polyadduct of 30 moles of ethylene oxide and 1 mole of a $C_{20}$–$C_{22}$fatty amine,
1 g/l of sodium acetate, and acetic acid for adjusting the liquor to a pH value of 5.5. This foam is then applied to the pile side of the carpet in the same manner as described in Example 1. The add-on of foam is 160%, based on the weight of the dry carpet. The carpet is then treated with saturated steam for 4½ minutes at 98° C. in a horizontal steamer, and subsequently rinsed and dried. A non-barry, level green dyeing of excellent light- and wetfastness is obtained.

EXAMPLE 4

A polyamide 66 cut-pile carpet having a weight of 2300 g/m$^2$ is impregnated on a pad to a pick-up of 100% with a liquor of the following composition:

0.325 g/l of the dye of the formula (22),
0.1 g/l of the dye of the formula (26),
0.13 g/l of the dye of the formula (27),
4 g/l of the ammonium salt of the acid sulfuric acid ester of the polyadduct of 2 moles of ethylene oxide and 1 mole of nonylphenol,
4 g/l of N-quaternised polyadduct of 30 moles of ethylene oxide and 1 mole of a $C_{20}$–$C_{22}$fatty amine,
1 g/l of sodium acetate, and acetic acid for adjusting the pH value of the liquor to 7. A liquor of the following composition is foamed and applied in the same manner as described in Example 1:

0.325 g/l of the dye of the formula (22),
0.1 g/l of the dye of the formula (26),
0.13 g/l of the dye of the formula (27),
2 g/l of the ammonium salt of the acid sulfuric acid ester of the polyadduct of 2 moles of ethylene oxide and 1 mole of nonylphenol, 4 g/l of the oxyalkylene-siloxane copolymer of the formula (6),
3 g/l of a N-quaternised polyadduct of 30 moles of ethylene oxide and 1 mole of a $C_{20}$–$C_{22}$fatty amine,
1 g/l of sodium acetate,
and acetic acid for adjusting the pH value of the liquor to 7. The blow ratio is 8:1.

This foam is applied to the pile side of the previously impregnated carpet. The add-on of foam is 100%, based on the weight of the dry carpet. The carpet is then treated with saturated steam for 6 minutes at 98°–100° C. in a steamer. The foam on the surface of the carpet collapses after 12 seconds. The carpet is subsequently rinsed and dried. A level, non-barry, golden-yellow dyeing of excellent light- and wetfastness is obtained.

EXAMPLE 5

A polyamide 66 cut-pile carpet having a weight of 1750 g/m$^2$ is impregnated on a pad to a pick-up of 100% with a liquor of the following composition:
0.7 g/l of the dye of the formula (22),
0.52 g/l of the dye of the formula (26),
0.15 g/l of the dye of the formula (27),
3 g/l of a mixture of the di(ethanol)amine salt of the acid sulfuric acid ester of the polyadduct of 3 moles of ethylene oxide and 1 mole of lauryl alcohol, and coconut fatty acid diethanolamide (1:1),
3 g/l of a N-quaternised polyadduct of 30 moles of ethylene oxide and 1 mole of a $C_{20}$–$C_{22}$fatty amine,
2 g/l of the oxyalkylene-silicone copolymer of the formula (6),
1 g/l of sodium acetate,
and acetic acid for adjusting the pH of the liquor to 6.

A liquor of the following composition is then foamed and applied as described in Example 1:
0.7 g/l of the dye of the formula (22),
0.52 g/l of the dye of the formula (26),
0.15 g/l of the dye of the formula (27),
3 g/l of a mixture of the diethanolamine salt of the acid sulfuric acid ester of the polyadduct of 3 moles of ethylene oxide and 1 mole of lauryl alcohol, and coconut fatty acid diethanolamide (1:1),
2 g/l of the oxyalkylene-siloxane copolymer of the formula (6),
3 g/l of a N-quaternised polyadduct of 30 moles of ethylene oxide and 1 mole of a $C_{20}$–$C_{22}$fatty amine,
1 g/l of sodium acetate,
and acetic acid for adjusting the pH of the liquor to 6. The blow ratio is 8:1.

This foam is applied to the pile side of the previously impregnated carpet. The add-on of foam is 100%, based on the weight of the dry carpet. The carpet is then treated with saturated steam for 5½ minutes at 100° C. in a steamer, and subsequently rinsed and dried. A level, non-barry, green dyeing of excellent light- and wetfastness is obtained.

EXAMPLE 6

A polyamide 66 cut-pile carpet having a weight of 1885 g/m$^2$ is impregnated on a pad to a pick-up of 40% with a liquor of the following composition:
2.5 g/l of the dye of the formula (22),
2.2 g/l of the dye of the formula (26),
2.2 g/l of the dye of the formula (27),
2 g/l of sodium laurylsulfate,
4 g/l of the oxyalkylene-siloxane copolymer of the formula (6),
3 g/l of a N-quaternised polyadduct of 30 moles of ethylene oxide and 1 mole of a $C_{20}$–$C_{22}$fatty amine,
1 g/l of sodium acetate,
and acetic acid for adjusting the pH of the liquor to 6.

A liquor of the following composition is then foamed and applied in the same manner as described in Example 1:
2.5 g/l of the dye of the formula (22),
2.2 g/l of the dye of the formula (26),
2.2 g/l of the dye of the formula (27),
2 g/l of sodium laurylsulfate,
4 g/l of the oxyalkylene-siloxane copolymer of the formula (6),
3 g/l of a N-quaternised polyadduct of 30 moles of ethylene oxide and 1 mole of a $C_{20}$–$C_{22}$fatty amine,
1 g/l of sodium acetate,
and acetic acid for adjusting the pH of the liquor to 6. The blow ratio is 9:1.

This foam is applied to the pile side of the previously impregnated carpet. The add-on of foam is 80%, based on the weight of the dry carpet. The carpet is then treated with saturated steam for 6 minutes at 98°–100° C. in a steamer, and subsequently rinsed and dried. A level brown dyeing of excellent light- and wetfastness is obtained.

EXAMPLE 7

A polyamide 66 cut-pile carpet having a weight of 580 g/m$^2$ is impregnated on a pad to a pick-up of 100% with the following liquor:
1.35 g/l of the dye of the formula (22),
0.9 g/l of the dye of the formula (26),
1.35 g/l of the dye of the formula (27),
4 g/l of the polyadduct of 9 moles of ethylene oxide and 7 moles of propylene oxide with 1 mole of a $C_{16}$–$C_{18}$fatty alcohol,
4 g/l of the oxyalkylene-siloxane copolymer of the formula (6),
1 g/l of sodium acetate,
and acetic acid for adjusting the pH of the liquor to 5.5.

A liquor of the following composition is then foamed and applied as described in Example 1:
1.35 g/l of the dye of the formula (22),
0.9 g/l of the dye of the formula (26),
1.35 g/l of the dye of the formula (27),
4 g/l of the polyadduct of 9 moles of ethylene oxide and 7 moles of propylene oxide with 1 mole of a $C_{16}$–$C_{18}$fatty alcohol,
4 g/l of the oxyalkylene-siloxane copolymer of the formula (6),
1 g/l of sodium acetate,
and acetic acid for adjusting the pH of the liquor to 5.5. The blow ratio is 8:1.

This foam is applied to the pile side of the previously impregnated carpet. The add-on of foam is 140%, based on the weight of the dry carpet. The carpet is then treated with saturated steam for 5½ minutes at 100° C. in a steamer, and subsequently rinsed and dried. A level brown dyeing of excellent light- and wetfastness is obtained.

EXAMPLE 8

A polyamide 66 cut-pile carpet having a weight of 720 g/m$^2$ is continuously prewetted in a liquor which contains 1 g/liter of the polyadduct of 9 moles of ethylene oxide and 1 mole of nonylphenol, and centrifuged to a pick-up of 50% by weight.

A foam having a blow ratio of 9:1 is prepared in a foaming apparatus from an aqueous liquor of the following composition:

0.17 g/l of the dye of the formula (22),
0.09 g/l of the dye of the formula (26),
0.14 g/l of the dye of the formula (27),
2 g/l of dodecylbenzenesulfonate,
4 g/l of the oxyalkylene-siloxane copolymer of the formula (6),
3 g/l of a N-quaternised polyadduct of 30 moles of ethylene oxide and 1 mole of a $C_{20}$–$C_{22}$fatty amine,
1 g/l of sodium acetate, and trisodium phosphate for adjusting the pH of the liquor to 8.5. This foam is then applied to the pile side of the carpet in the same manner as described in Example 1. The add-on of foam is 160%, based on the weight of the dry carpet. The carpet is then treated with saturated steam for 4 minutes at 100° C. in a horizontal steamer, and subsequently rinsed and dried. A non-barry, level, golden-yellow dyeing of excellent light- and wetfastness is obtained.

EXAMPLE 9

A polyamide 66 cut-pile carpet having a weight of 600 g/m$^2$ is continuously prewetted in a liquor which contains 1 g/liter of the polyadduct of 9 moles of ethylene oxide and 1 mole of nonylphenol, and centrifuged to a pick-up of 50% by weight. A foam having a blow ratio of 8:1 is prepared in a foaming apparatus from an aqueous liquor of the following composition:

0.25 g/l of the dye of the formula (22),
0.2 g/l of the dye of the formula (26),
0.2 g/l of the dye of the formula (27),
4 g/l of the polyadduct of 12 moles of ethylene oxide and 12 moles of propylene oxide with 1 mole of a $C_4$–$C_{18}$fatty alcohol,
4 g/l of the oxyalkylene-siloxane copolymer of the formula (6),
1 g/l of sodium acetate, and trisodium phosphate for adjusting the pH of the liquor to 7.5. This foam is then applied to the pile side of the carpet in the same manner as described in Example 1. The add-on of foam is 180%, based on the weight of the dry carpet. The carpet is then treated with saturated steam for 4 minutes at 100° C. in a horizontal steamer, and subsequently rinsed and dried. A non-barry, level beige dyeing of excellent light- and wetfastness is obtained.

EXAMPLE 10

A polyamide 66 cut-pile carpet having a weight of 720 g/m$^2$ is continuously prewetted in a liquor which contains 1 g/liter of the polyadduct of 9 moles of ethylene oxide and 1 mole of nonylphenol, and centrifuged to a pick-up of 50% by weight. A dye foam having a blow ratio of 8:1 is prepared in a foaming apparatus from an aqueous liquor of the following composition:

0.95 g/l of the dye of the formula (22),
0.72 g/l of the dye of the formula (26),
0.2 g/l of the dye of the formula (27),
4 g/l of the polyadduct of 9.5 moles of ethylene oxide and 9.5 moles of propylene oxide with 1 mole of nonylphenol,
2 g/l of a N-quaternised polyadduct of 30 moles of ethylene oxide and 1 mole of a $C_{20}$–$C_{22}$fatty amine,
1 g/l of sodium acetate, and acetic acid for adjusting the pH of the liquor to 6.

This foam is applied to the pile side of the carpet in the same manner as described in Example 1. The add-on of foam is 150%, based on the weight of the dry carpet. The carpet is then treated with saturated steam for 4½ minutes at 100° C. in a horizontal steamer, and subsequently rinsed and dried. A non-barry, level green dyeing of excellent light- and wetfastness is obtained In Examples 2 to 10, the polyether siloxanes of the formulae (7) to (15) can also be used as foam regulators.

What is claimed is:

1. A method of treating a textile fabric with a foam, comprising the steps of preparing a foam with a blow ratio of (6 to 20):1 from a composition which contains (a) 1 to 4 g./l. of an anionic or non-ionic surfactant, or a mixture thereof, as foam stabilizer,
(b) 0.1 to 1 g./l. of a polyether siloxane, having an antifoam action at elevated temperature and having a cloud point in the range of 20° to 70° C., as foam regulator.
(c) water, and
(d) dye, fluorescent whitening agent or finishing agent, applying said foam continuously in the form of at least one layer to the textile fabric and subjecting the fabric to a steam treatment.

2. The method of claim 1, comprising the further step of applying a vacuum to the textile fabric to effect partial penetration of the layer of foam through the fabric prior to the steam treatment.

3. The method of claim 2, wherein the foam stabilizer is (1a) an ester of a polybasic acid of an alkylphenol-/ethylene oxide polyadduct containing 4 to 12 carbon atoms in the alkyl moiety and 2 to 12 ethylene oxide units, or a salt thereof,
(1b) an ester of a polybasic acid of a fatty alcohol-/ethylene oxide adduct containing 1 to 4 ethylene oxide units, or a salt thereof,
(2) an alkylphenylsulfonate containing 8 to 18 carbon atoms in the alkyl moiety,
(4a) an alkylphenol/ethylene oxide polyadduct containing 8 or 9 carbon atoms in the alkyl moiety and 2 to 12 ethylene oxide units, or
(6) a fatty acid dialkanolamide containing 8 to 12 carbon atoms in the fatty acid radical, which components are used individually or in admixture, and wherein the foam regulator is an oxyalkylene-siloxane copolymer.

4. A method according to claim 3, wherein the foam stabiliser (a) additionally contains (3) a sulfonated 1-benzyl-2-alkylbenzimidazole containing 8 to 22 carbon atoms in the alkyl moiety.

5. A method according to claim 1, wherein the anionic surfactant is (1) an acid ester, or salt thereof, of a polyadduct of 2 to 15 moles of ethylene oxide and 1 mole of a fatty alcohol containing 8 to 22 carbon atoms or 1 mole of an alkylphenol containing 4 to 12 carbon atoms in the alkyl moiety,
(2) an alkylphenylsulfonate containing 8 to 18 carbon atoms in the alkyl moiety, or
(3) a sulfonated 1-benzyl-2-alkylbenzimidazole containing 8 to 22 carbon atoms in the alkyl moiety, which components (1), (2) and (3) are used individually or in admixture.

6. A method according to claim 1, wherein the non-ionic surfactant is (4) a polyadduct of 2 to 15 moles of ethylene oxide and 1 mole of a fatty alcohol or fatty acid, each containing 8 to 22 carbon atoms, or 1 mole of an alkylphenol containing a total of 4 to 12 carbon atoms in the alkyl moiety, (5) a fatty alcohol of 8 to 22 carbon atoms or an ethylene-oxide adduct of said fatty alcohol containing 1 to 3 oxyethylene groups, or (6) a fatty acid dialkanolamide containing 8 to 22 carbon atoms in the fatty acid radical, which components (4), (5) and (6) are used individually or in admixture.

7. A method according to claim 1, wherein the foam stabiliser (a) is (1) an acid ester, or a salt thereof, of a polyadduct of 2 to 15 moles of ethylene oxide and 1 mole of a fatty alcohol containing 8 to 22 carbon atoms or 1 mole of an alkylphenol containing 4 to 12 carbon atoms in the alkyl moiety, (2) an alkylphenylsulfonate containing 8 to 18 carbon atoms in the fatty acid radical, (4) a polyadduct of 2 to 15 moles of ethylene oxide and 1 mole of a fatty alcohol or fatty acid, each containing 8 to 22 carbon atoms, or 1 mole of an alkylphenol containing a total of 4 to 12 carbon atoms in the alkyl moiety, (5) a fatty alcohol of 8 to 22 carbon atoms or an ethylene-oxide adduct of said fatty alcohol containing 1 to 3 oxyethylene groups, or (6) a fatty acid dialkanolamide containing 8 to 22 carbon atoms in the fatty acid radical which components (1), (2), (4), (5) and (6) are used individually or in admixture.

8. A method according to claim 7, wherein the foam stabiliser (a) additionally contains (3) a sulfonated 1-benzyl-2-alkylbenzimidazole containing 8 to 22 carbon atoms in the alkyl moiety.

9. A method according to claim 8, wherein the sulfonated 1-benzyl-2-alkylbenzimidazole contains 16 to 18 carbon atoms in the alkyl moiety.

10. A method according to claim 8, wherein the foam stabiliser (a) is a mixture of dodecylbenzenesulfonate, sodium triglycol ether sulfate, coconut fatty acid diethanolamide and the disodium salt of 1-benzyl-2-stearylbenzimidazole-disulfonic acid.

11. A method according to claim 1, wherein the foam stabiliser (a) is a nonylphenol/ethylene oxide polyadduct containing 2 to 12 ethylene oxide units.

12. A method according to claim 1, wherein the foam stabiliser (a) is a sulfuric or phosphoric acid ester of an alkylphenol/ethylene oxide polyadduct containing 8 to 12 carbon atoms in the alkyl moiety and 2 to 12 ethylene oxide units, or an alkali metal salt, ammonium salt or amine salt thereof.

13. A method according to claim 1, wherein the foam stabiliser (a) is a sulfuric acid ester of a fatty alcohol-/ethylene oxide polyadduct containing 8 to 18 carbon atoms in the alcohol radical and 2 to 4 ethylene oxide units, or an alkali metal salt thereof.

14. A method according to claim 1, wherein the foam stabiliser (a) is an alkylphenylsulfonate containing 8 to 12 carbon atoms in the alkyl moiety.

15. A method according to claim 1, wherein the foam stabiliser (a) is a fatty acid diethanolamide containing 8 to 18 carbon atoms in the fatty acid radical.

16. A method according to claim 1, wherein the foam stabiliser (a) is a mixture of the polyadduct of 7 to 15 moles of ethylene oxide and 1 mole of stearyl alcohol, coconut fatty acid diethanolamide and cetyl alcohol or diethylene glycol cetyl ether.

17. A method according to claim 1, wherein the foam stabiliser (a) is a mixture of a nonylphenol/ethylene oxide polyadduct containing 10 to 12 ethylene oxide units, the sodium salt of a sulfuric acid ester of a fatty alcohol/ethylene oxide polyadduct containing 10 to 12 carbon atoms in the alcohol radical and 2 to 4 ethylene oxide units and coconut fatty acid diethanolamide.

18. A method according to claim 1, wherein the foam stabiliser (a) is the polyadduct of 1 mole of nonylphenol and 2 moles of ethylene oxide, the ammonium salt of the acid sulfuric acid ester of the polyadduct of 1 mole of nonylphenol and 2 moles of ethylene oxide, sodium lauryl triglycol ether sulfate, sodium dodecylphenylsulfonate, or a fatty acid diethanolamide containing 8 to 18 carbon atoms in the fatty acid radical.

19. A method according to claim 1, wherein the foam stabiliser (a) is a mixture of sodium lauryl triglycol ether sulfate, and a fatty acid diethanolamide containing 8 to 18 carbon atoms in the fatty acid radical.

20. A method according to claim 1, wherein the non-ionic surfactant is an alkylene oxide polyadduct of the formula $$R'-O-(CH_2CH_2-O)_{n1}-(\underset{\underset{Z_1}{|}}{CH}-\underset{\underset{Z_2}{|}}{CH}-O)_y-(CH_2CH_2O)_{n2}-H \quad (4)$$

wherein R′ is hydrogen, alkyl or alkenyl, each containing at most 18 carbon atoms, o-phenyl-phenyl or alkylphenyl containing 4 to 12 carbon atoms in the alkyl moiety, one of $Z_1$ and $Z_2$ is hydrogen and the other is methyl, y is 1 to 15, and the sum of $n_1+n_2$ is 3 to 15.

21. A method according to claim 20, wherein the non-ionic surfactant is a polyadduct of 3 to 10 moles of ethylene oxide and 3 to 10 moles of propylene oxide with an alkanol or alkenol each containing 8 to 16 carbon atoms.

22. A method according to claim 1, wherein the foam regulator (b) is a polyether siloxane with a cloud point of 25° to 50° C.

23. A method according to claim 1, wherein the foam regulator (b) is a reaction product of a halogen-substituted organopolysiloxane and an alkali metal salt of a polyoxyalkylene.

24. A method according to claim 1, wherein a foamed dye composition is applied continuously, in the form of a layer, to the textile fabric with an applicator roll, a vacuum of >0 to 1 bar is then applied to effect sufficient penetration of the foam into the fabric that the layer of foam remaining on the surface thereof is reduced in height, and the fabric is then subjected to a steam treatment, rinsed with water, and finally dried.

25. A method according to claim 1, wherein a first layer of foam is applied to the pile side of a carpet, then a vacuum is applied to effect penetration of the foam, a second layer of foam is then applied, and the carpet is thereafter subjected to a steam treatment and subsequently rinsed with water and dried.

26. A method according to claim 25, wherein the carpet is dyed with the foam, steamed, rinsed with water and finally dried.

27. A method according to claim 1, wherein a foamed finishing composition is applied continuously with an applicator roll, in a layer, to the textile fabric, a vacuum of >0 to 1 bar is applied to effect sufficient penetration of the foam into the fabric that the layer of foam remaining on the surface thereof is reduced in height, and the fabric is subsequently subjected to a steam treatment.

28. A method according to claim 27, wherein the foamed finishing composition is applied to the textile fabric in succession from each side.

29. A method according to claim 1, wherein a carpet is impregnated with an aqueous dye liquor, then the foamed composition is applied, and the dyeing is fixed by steaming.

30. A foamed, aqueous composition having a blow ratio of (6 to 20):1 and containing (a) 1 to 4 g./l. of an anionic or non-ionic surfactant, or a mixture thereof, as foam stabilizer, (b) 0.1 to 1 g./l. of a polyether siloxane, having an antifoam action at elevated temperature and having a cloud point in the range of 20° to 70° C. as foam regulator, (c) water, and (d) dye, fluorescent whitening agent or finishing agent.

* * * * *